US008232743B2

(12) United States Patent
Chen et al.

(10) Patent No.: US 8,232,743 B2
(45) Date of Patent: Jul. 31, 2012

(54) VOLTAGE CONVERTER AND DRIVING METHOD FOR USE IN A BACKLIGHT MODULE

(75) Inventors: Ke-Horng Chen, Taipei County (TW); Chi-Lin Chen, Taipei County (TW); Yao-Yi Yang, Changhua County (TW); Ling Li, Hualien (TW); Chia-Lin Liu, Taichung County (TW); Chi-Neng Mo, Taoyuan County (TW)

(73) Assignee: Chunghwa Pictures Tubes, Ltd., Bade, Taoyuan (TW)

( * ) Notice: Subject to any disclaimer, the term of this patent is extended or adjusted under 35 U.S.C. 154(b) by 283 days.

(21) Appl. No.: 12/831,231

(22) Filed: Jul. 6, 2010

(65) Prior Publication Data

US 2011/0254468 A1 Oct. 20, 2011

(30) Foreign Application Priority Data

Apr. 20, 2010 (TW) ..... 99112337 A

(51) Int. Cl.
*H05B 37/02* (2006.01)

(52) U.S. Cl. ..... 315/307; 315/232; 315/295

(58) Field of Classification Search ..... 315/291, 315/294–295, 297, 306, 307, 308, 227 R–244
See application file for complete search history.

(56) References Cited

U.S. PATENT DOCUMENTS

| | | | | |
|---|---|---|---|---|
| 7,825,610 | B2 * | 11/2010 | Zhao et al. | 315/299 |
| 7,919,936 | B2 * | 4/2011 | Liu et al. | 315/307 |
| 7,928,670 | B2 * | 4/2011 | Chen et al. | 315/308 |
| 2006/0028150 | A1 | 2/2006 | Vitunic | |
| 2006/0082412 | A1 | 4/2006 | D'Angelo | |

FOREIGN PATENT DOCUMENTS

CN 101488703 A 7/2009

* cited by examiner

*Primary Examiner* — James H Cho
(74) *Attorney, Agent, or Firm* — Winston Hsu; Scott Margo

(57) ABSTRACT

A voltage converter for use in a backlight module stores energy of an input voltage using an inductor and outputs a plurality of output voltages accordingly. The charging path of the inductor is controlled according to the first output voltage so that the first output voltage can be stabilized. The discharging paths from the inductor to other output voltages are controlled according to the differences between other output voltages and the first output voltage so that other output voltages can also be stabilized.

14 Claims, 9 Drawing Sheets

VOLTAGE CONVERTER AND DRIVING METHOD FOR USE IN A BACKLIGHT MODULE

BACKGROUND OF THE INVENTION

1. Field of the Invention

The present invention is related to a voltage converter and related driving method, and more particularly, to a voltage converter and related driving method for use in a backlight module.

2. Description of the Prior Art

Light-emitting diodes (LEDs), characterized in low power consumption, long lifetime, high color saturation, fast reaction, anti-quake/pressure ability and small size, have been widely used as backlights in various electronic devices, such as liquid crystal displays (LCDs), scanners, advertising signs or notebook computers. According to actual application, the prior art backlight module normally adopts a white backlight using white LEDs or an RGB backlight using red, green and blue (hereafter as RGB) LEDs.

FIG. 1 is a diagram of a prior art backlight module which includes a DC-DC voltage converter 100 and a backlight 130. The voltage converter 100, including a voltage booster 11 and a pulse width modulation (PWM) circuit 120, is configured to convert an input voltage $V_{IN}$ into an output voltage $V_{OUT}$ for driving the backlight 130. In the backlight 130, white light is generated using white LEDs $D_{W1}$-$D_{Wn}$ and light of other various colors is generated using a color filter. The voltage booster 110 includes an inductor L, a power switch QN, a diode D, resistors R1 and R2, and an output capacitor Co. The power switch QN is configured to control the charging and discharging paths of the inductor L according to a control signal NG: when the power switch QN is turned on, the input voltage $V_{IN}$ charges the inductor L; when the power switch QN is turned off, the energy stored in the inductor L is discharged via the turned-on diode D and transferred to the output capacitor Co, thereby providing the output voltage $V_{OUT}$ for operating the backlight 130. A feedback circuit formed by the resistors R1 and R2 provides a corresponding feedback voltage $V_{FB}$ by voltage-dividing the output voltage $V_{OUT}$. The boost control circuit 120 is configured to generate the control signal NG according to the feedback voltage $V_{FB}$: when the output voltage $V_{OUT}$ is too large, the PWM circuit 120 reduces the turn-on time of the power switch QN by adjusting the duty cycle of the control signal NG; when the output voltage $V_{OUT}$ is too small, the PWM circuit 120 increases the turn-on time of the power switch QN by adjusting the duty cycle of the control signal NG. The prior art voltage converter 100 controls the charging and discharging of the inductor L according to variations in the output voltage $V_{OUT}$, thereby capable of stabilizing the output voltage $V_{OUT}$. By driving the white backlight 130 using the voltage converter 100, the prior art backlight module is inexpensive and consumes small amount of power, but is unable to provide high quality images due to low color saturation.

FIG. 2 is a diagram of a prior art backlight module which includes a DC-DC voltage converter 200 and a backlight 230. The voltage converter 200, including a voltage booster 110 and a PWM circuit 120, is configured to convert an input voltage $V_{IN}$ into an output voltage $V_{OUT}$ for driving the backlight 230. In the backlight 230, RGB light is generated using red LEDs $D_{R1}$-$D_{Rn}$, green LEDs $D_{G1}$-$D_{Rn}$ and blue LEDs $D_{B1}$-$D_{Bn}$, respectively. High quality images can thus be provided by color mixing instead of using a color filter. However, different types of LEDs have different characteristics. For example, the voltage drop of an red LED is normally smaller than that of a blue LED or a green LED. Therefore, the output voltage $V_{OUT}$ of a specific value can not be simultaneously used for displaying multiple colors. Also, the visual effect of images may be downgraded since it requires time to switch between different colors.

FIG. 3 is a diagram of a prior art backlight module which includes a DC-DC voltage converter 300 and a backlight 330. The voltage converter 300, including three voltage boosters 111-113 and three PWM circuit 121-123, is configured to convert an input voltage $V_{IN}$ into three output voltages $V_{OUT1}$-$V_{OUT3}$ for respectively driving red LEDs $D_{R1}$-$D_{Rn}$, green LEDs $D_{G1}$-$D_{Rn}$ blue LEDs $D_{B1}$-$D_{Bn}$, in the backlight 330. High quality images can thus be provided by color mixing instead of using a color filter. The structures and the operations of the voltage boosters 111-113 and the PWM circuit 121-123 in FIG. 3 are similar to those of the voltage booster 110 and the PWM circuit 120 in FIG. 1. For accommodating different characteristics of the RGB LEDs, the prior art DC-DC voltage converter 300 provides three output voltages $V_{OUT1}$-$V_{OUT3}$ using three voltage boosters 111-113. The three inductors L required in the voltage boosters 111-113 occupy large space and increase manufacturing costs.

SUMMARY OF THE INVENTION

The present invention provides a voltage converter for use in a backlight module. The voltage converter includes an inductor configured to store an energy of an input voltage; a power switch configured to control a charging path of the inductor according to a switch control signal; a first capacitor configured to provide a first output voltage by storing an energy of the inductor; a second capacitor configured to provide a second output voltage by storing the energy of the inductor; a third capacitor configured to provide a third output voltage by storing the energy of the inductor; a first switch configured to control a signal transmission path between the inductor and the first capacitor according to a first control signal; a second switch configured to control a signal transmission path between the inductor and the second capacitor according to a second control signal; a third switch configured to control a signal transmission path between the inductor and the third capacitor according to a third control signal; a first feedback circuit configured to provide a first feedback voltage corresponding to the first output voltage; a second feedback circuit configured to provide a second feedback voltage corresponding to the second output voltage; a third feedback circuit configured to provide a third feedback voltage corresponding to the third output voltage; and a boost control circuit configured to generate the switch control signal according to the first feedback signal, generate the first control signal according to the first feedback signal and the switch control signal, generate the second control signal according to the first feedback signal, the second feedback signal and the first control signal, and generate the third control signal according to the first feedback signal, the third feedback signal and the second control signal.

The present invention further provides a driving method for operating a backlight module. The driving method includes an energy-storing device receiving an input voltage for storing a corresponding energy; providing a first output voltage, a second output voltage and a third output voltage by receiving the energy stored in the energy-storing device; controlling a signal transmission path between the input voltage and the energy-storing device according to a first feedback voltage, wherein the first feedback voltage is related to the first output voltage; controlling a signal transmission path between the energy-storing device and the first output voltage according to the first feedback voltage; controlling a signal transmission path between the energy-storing device and the second output voltage according to the first feedback voltage and a second feedback voltage, wherein the second feedback voltage is related to the second output voltage; and controlling a signal transmission path between the energy-storing device and the third output voltage according to the first feedback voltage and a third feedback voltage, wherein the third feedback voltage is related to the third output voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
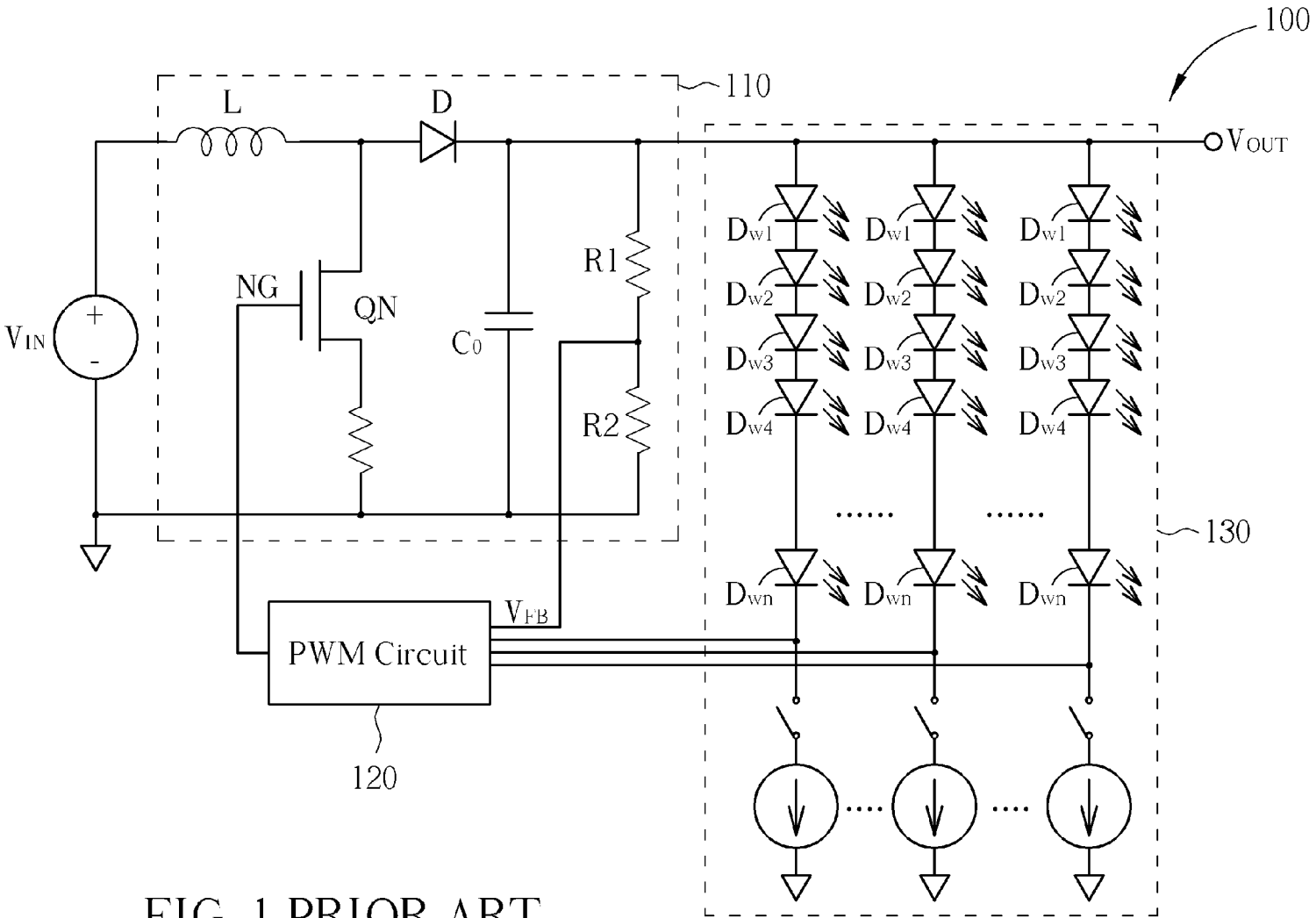
FIG. 1 PRIOR ART
FIGS. 1-3 are diagrams of a prior art backlight module.
Figure 2:
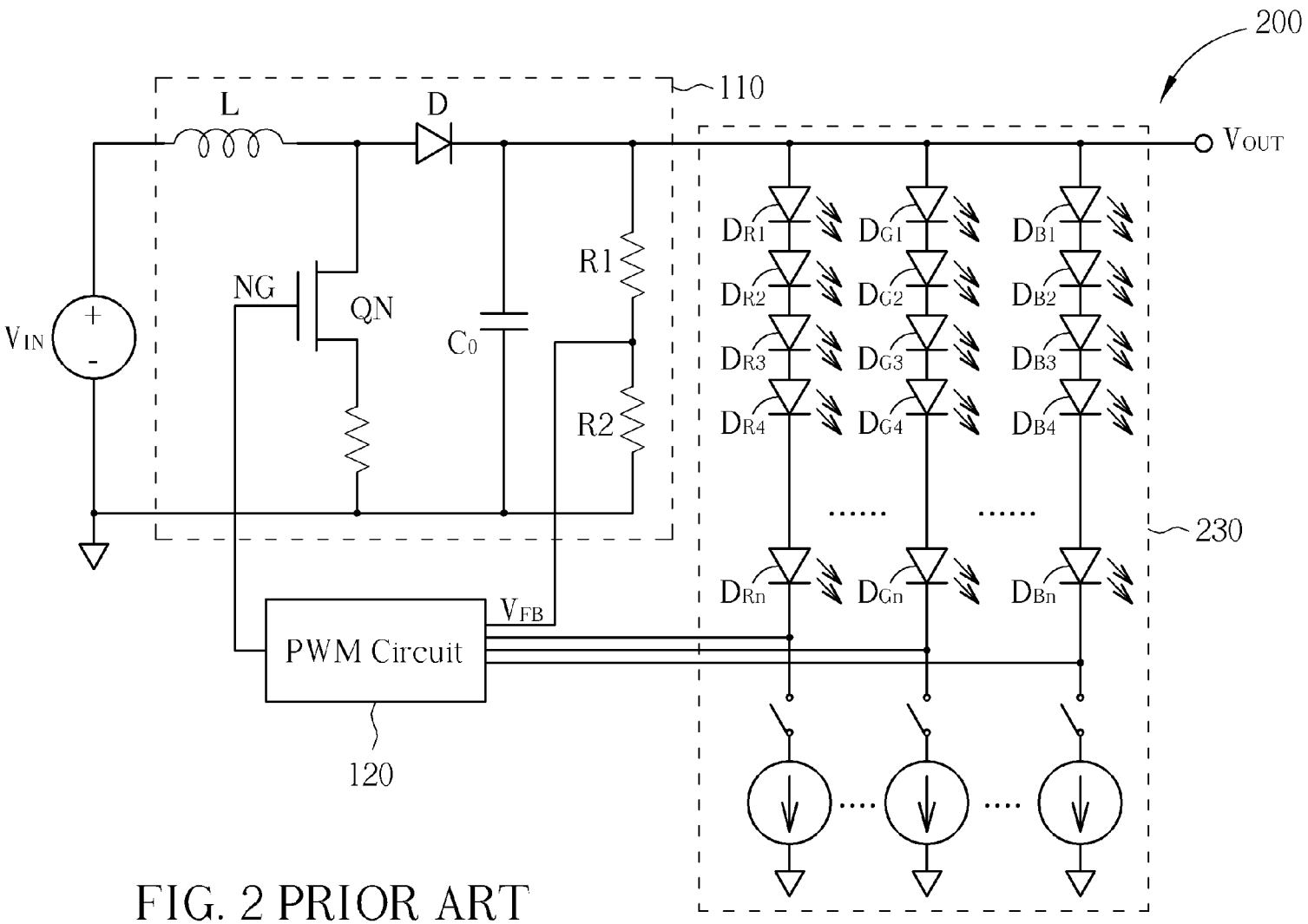
FIG. 2 PRIOR ART
Figure 3:
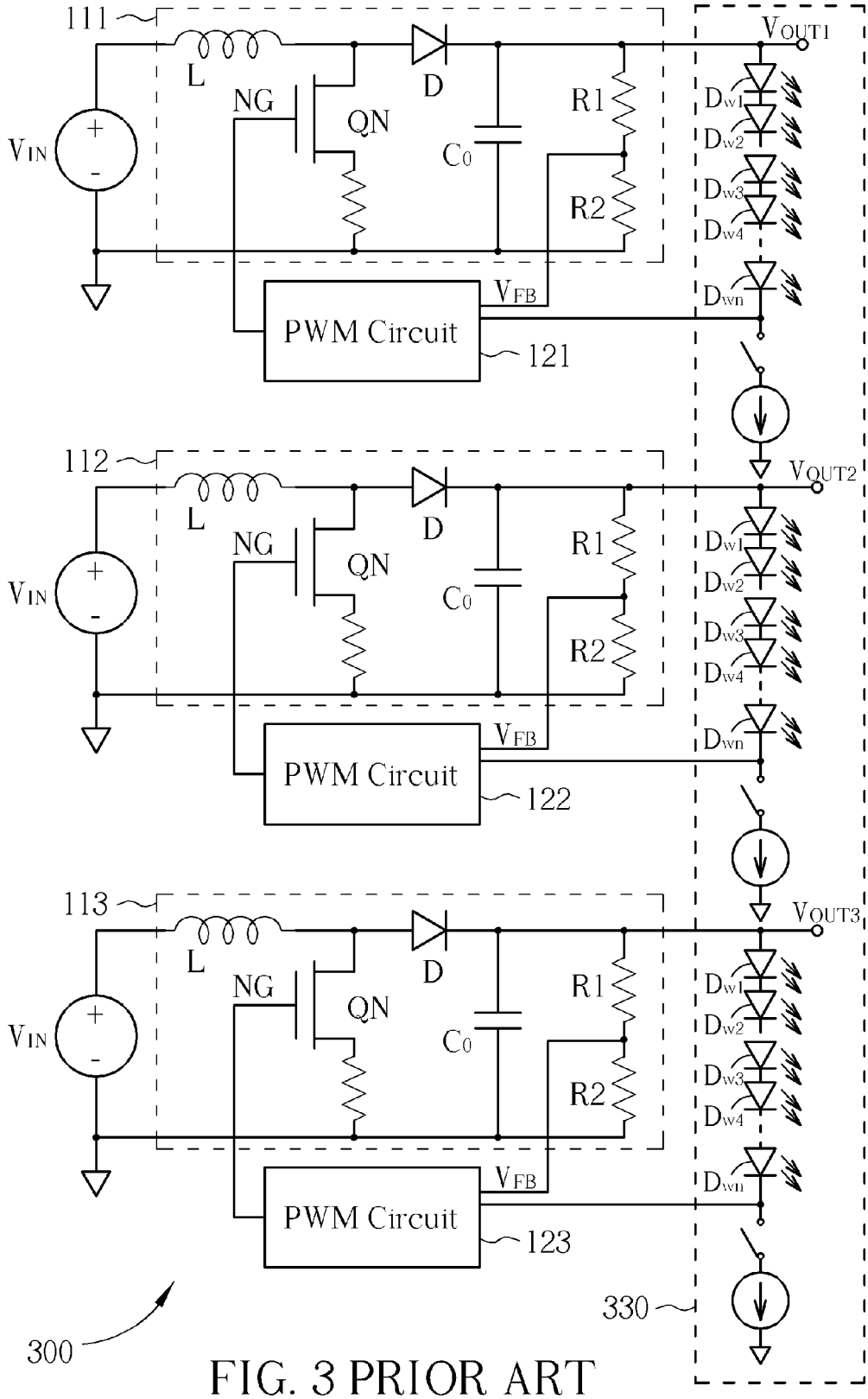
FIG. 3 PRIOR ART
Figure 4:
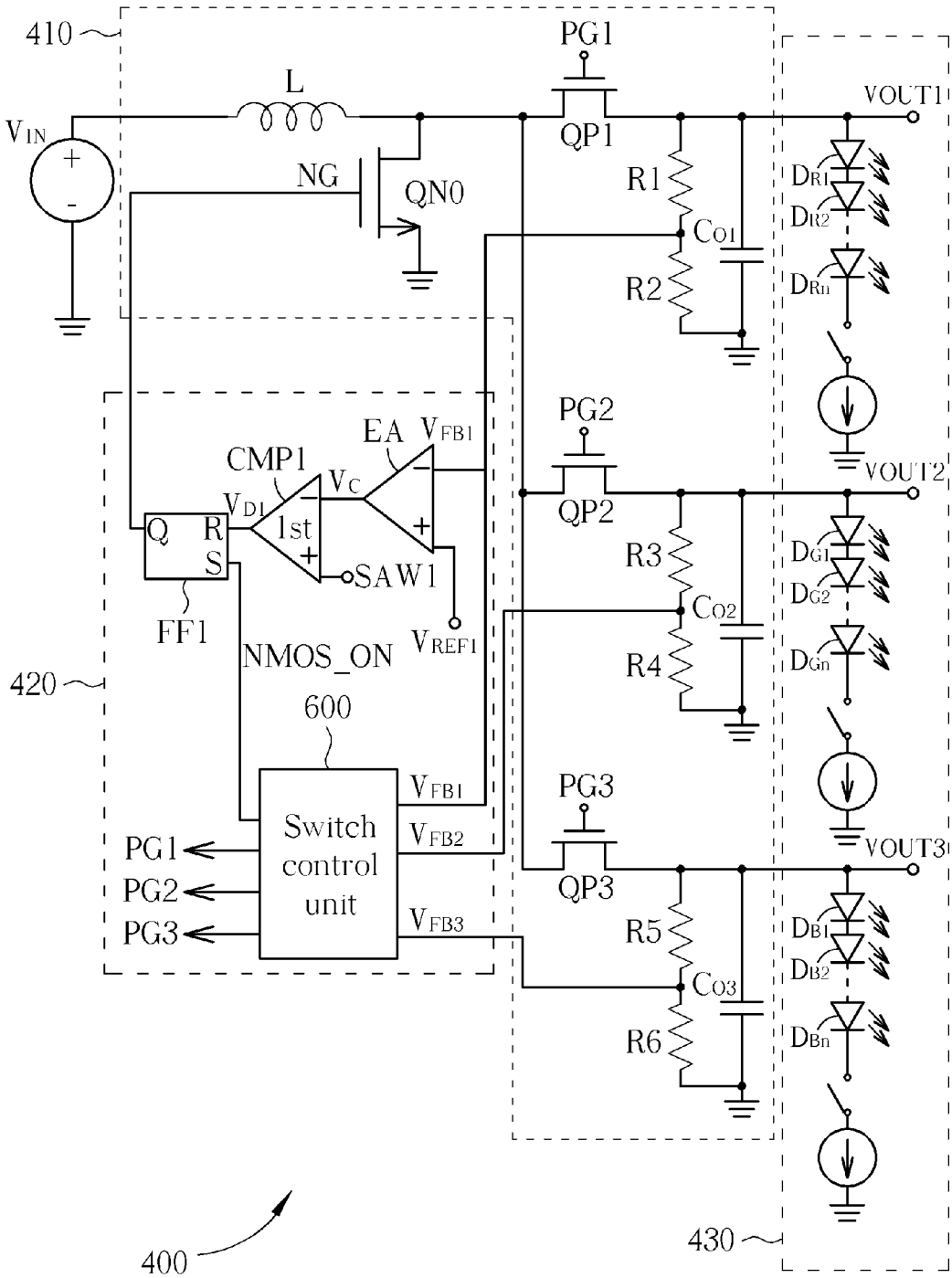
FIG. 4 is a diagram of a backlight module according to the present invention.

FIG. 4 is a diagram of a backlight module of the present invention which includes a DC-DC voltage converter 400 and a backlight 430. The voltage converter 400, including a voltage booster 410 and a boost control circuit 420, is configured to convert an input voltage $V_{IN}$ into three output voltages $V_{OUT1}$-$V_{OUT3}$ for respectively driving red LEDs $D_{R1}$-$D_{Rn}$, green LEDs $D_{G1}$-$D_{Rn}$ blue LEDs $D_{B1}$-$D_{Bn}$ in the backlight 430. High quality images can thus be provided by color mixing instead of using a color filter. For accommodating different characteristics of the RGB LEDs, the voltage converter 400 of the present invention adjusts the output voltages $V_{OUT1}$-$V_{OUT3}$ using the boost control 420. Since only one inductor L is required in the voltage booster 410, the size of the backlight module and the manufacturing costs may be reduced.

The voltage booster 410 includes an inductor L, a power switch QN0, first to third switches QP1-QP3, first to sixth resistors R1-R6, and first to third capacitors $C_{O1}$-$C_{O3}$. The power switch QN0 may be an N-type metal-oxide-semiconductor (NMOS) transistor switch which is configured to control the charging path of the inductor L according to a switch control signal NG. The first to third QP1-QP3 may be P-type metal-oxide-semiconductor (PMOS) transistor switches which are configured to control the discharging paths of the inductor L according to first to third control signals PG1-PG3, respectively. In the voltage converter 400 according to the present invention, only one switch among the switches QN0 and QP1-QP3 is turned on at the same time: when the power switch QN is turned on and the switches QP1-QP3 are turned off, the input voltage $V_{IN}$ charges the inductor L; after the charging is completed, the power switch QN0 is turned off and the inductor L is discharged via the turned on switches QP1-QP3. The energy of the inductor L may be transferred to the capacitors $C_{O1}$-$C_{O3}$, thereby providing the output voltages $V_{OUT1}$-$V_{OUT3}$ for operating the backlight 430. Meanwhile, a first feedback circuit formed by the resistors R1 and R2 provides a corresponding feedback voltage $V_{FB1}$ by voltage-dividing the first output voltage $V_{OUT1}$; a second feedback circuit formed by the resistors R3 and R4 provides a corresponding feedback voltage $V_{FB2}$ by voltage-dividing the second output voltage $V_{OUT2}$; a third feedback circuit formed by the resistors R5 and R6 provides a corresponding feedback voltage $V_{FB3}$ by voltage-dividing the third output voltage $V_{OUT3}$.

The boost control circuit 420 includes an error amplifier EA, a first comparator CMP1, a first flip-flop FF1, and a switch control unit 600. The boost control circuit 420 is configured to generate the control signal NG according to the feedback voltage $V_{FB1}$ and generate the control signals PG1-PG3 according to the feedback voltages $V_{FB1}$-$V_{FB3}$, thereby controlling the turn-on and turn-off time of the switches QN0 and QP1-QP3.

The voltage converter 400 of the present invention adopts a single inductor multi-output (SIMO) structure in which the switches QN0, QP1, QP2 and QP3 are sequentially tuned on. When the power switch QN0 is turned on, the energy of the input voltage $V_{IN}$ may be stored in the inductor L. By sequentially turning on the switches QP1-QP3 after turning off the power switch QN0, the stored energy of the inductor L may be used for supplying the output voltages $V_{OUT1}$-$V_{OUT3}$ sequentially. TN0, TP1, TP2 and TP3 represent the turn-on time of the switches QN0, QP1, QP2 and QP3, respectively.

In the present invention, the power switch QN0 is turned off according to the feedback voltage $V_{FB1}$ which corresponds to the output voltage $V_{OUT1}$. The error amplifier EA is configured to generate a corresponding compare signal $V_C$ by comparing the difference between the feedback voltage $V_{FB1}$ and a first reference voltage $V_{REF1}$. The first comparator CMP1 is configured to generate a corresponding digital control signal $V_{D1}$ by comparing the compare signal $V_c$ with a constant-slope ramp voltage SAW1: the first comparator CMP1 outputs a digital control signal $V_{D1}$ having high level (logic 1) when the ramp voltage SAW1 reaches the compare signal $V_C$. The first flip-flop FF1 may be an RS flip-flop which outputs a switch control signal NG having disable level at its Q terminal for turning off the power switch QN0 when its R terminal is triggered by a logic 1 signal, and outputs a switch control signal NG having enable level at its Q terminal for turning on the power switch QN0 when its S terminal is triggered by a logic 1 signal (for example, enable level refers to logic 1 and disable level refers to logic 0 for an NMOS transistor switch). In other words, the switch control signal NG for operating the power switch QN0 is provided by the switch control unit 600.

Figure 5A:
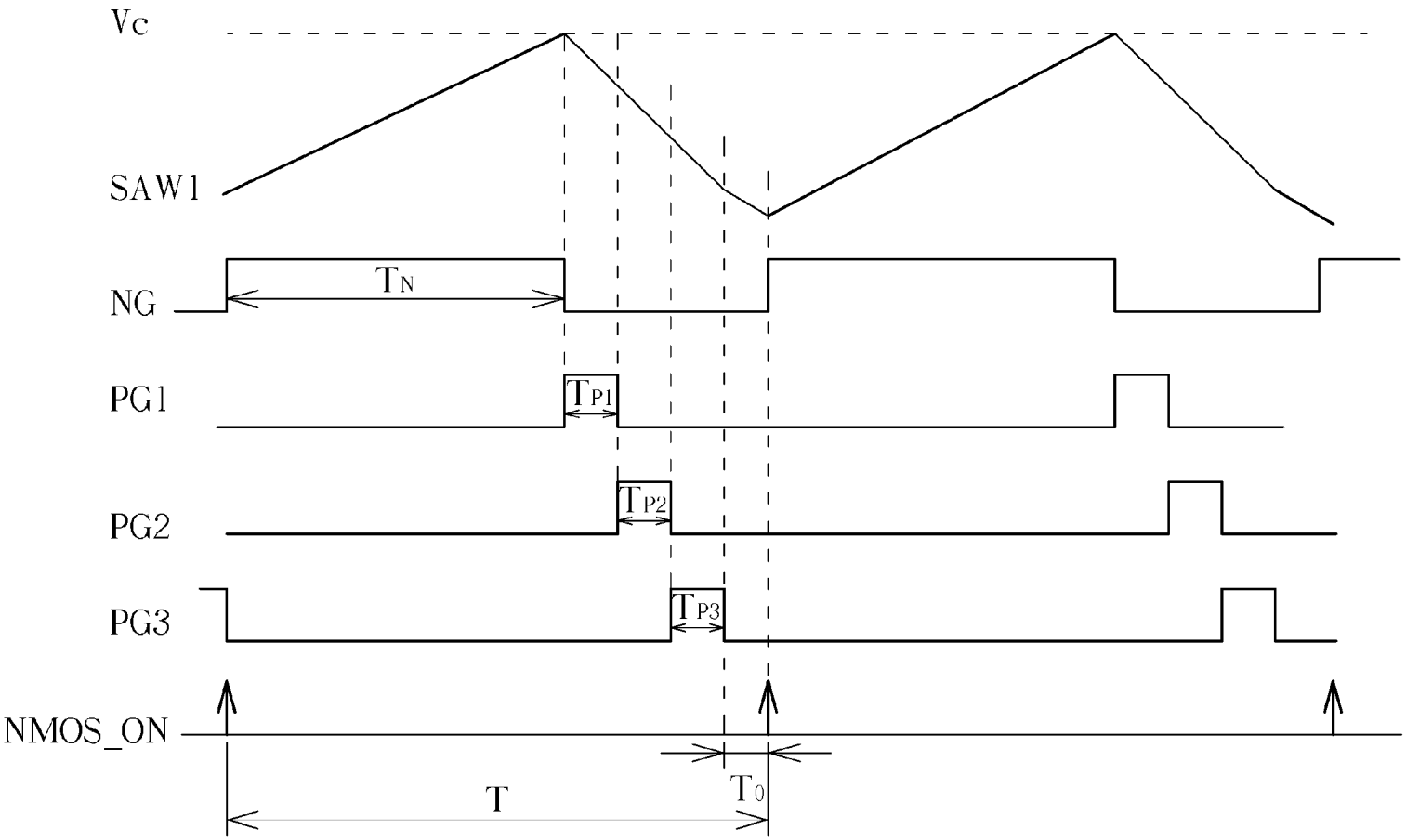
FIG. 5*a* is a timing diagram illustrating the operations of a voltage converter according to a constant-frequency driving method of the present invention.
Figure 5B:
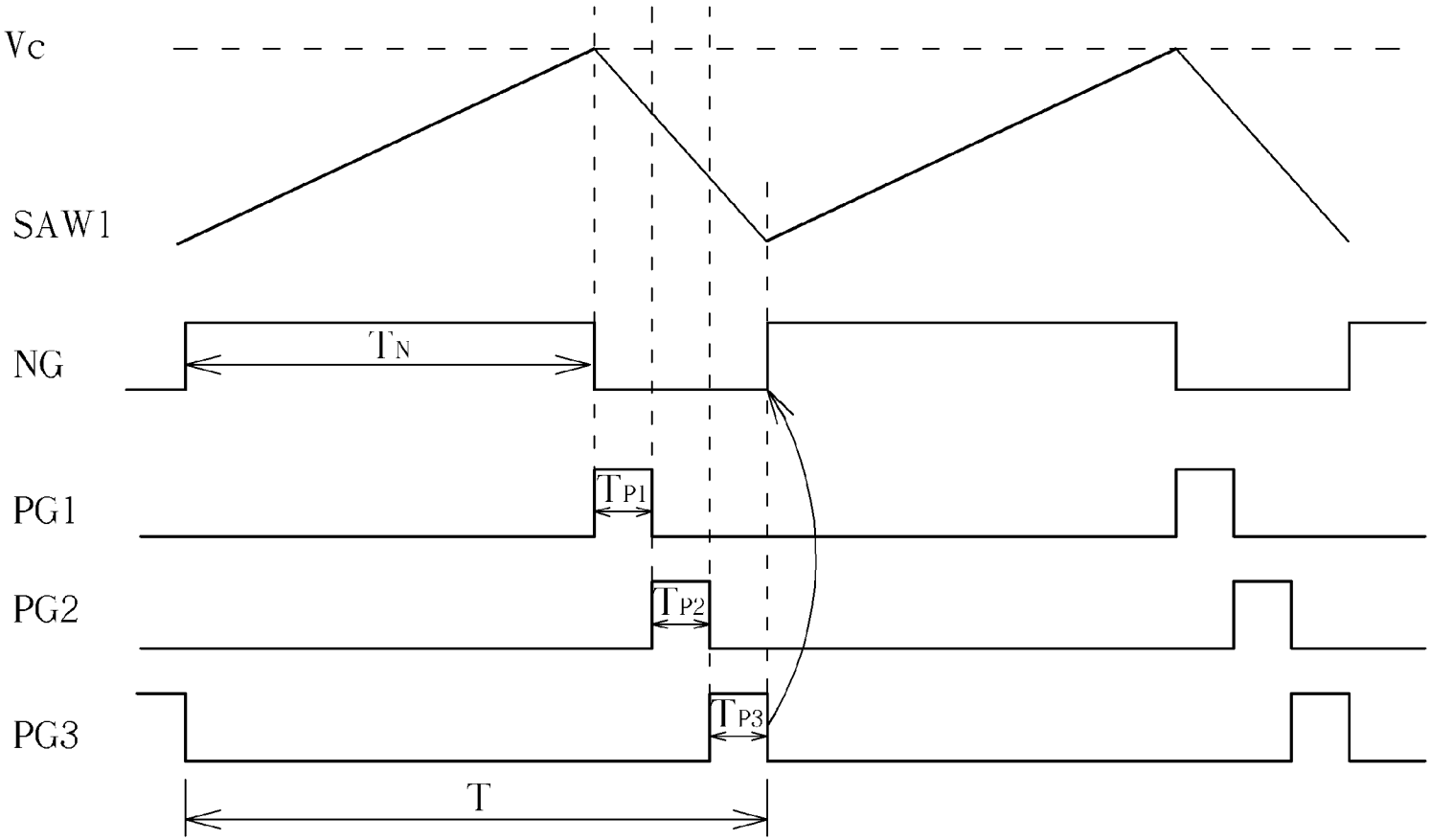
FIG. 5*b* is a timing diagram illustrating the operations of a voltage converter according to a variable-frequency driving method of the present invention.

FIGS. 5*a* and 5*b* are timing diagrams illustrating the operations of the voltage converter 400 according to the present invention. For illustrating how the power switch QN0 is turned on and off, the waveforms of the compare voltage $V_C$, the ramp voltage SAW1, the switch control signal NG, the first to third control signals PG1-PG3, and a pulse signal NMOS_ON are depicted. During a period T, $T_N$, $T_{P1}$/$T_{P2}$ and $T_{P3}$ represent the turn-on time of the switches QN0, QP1, QP2 and QP3, respectively. In the embodiment illustrated in FIG. 5*a*, the power switch QN0 is turned on according to a constant-frequency driving method in which the switch control unit 600 provides the pulse signal NMOS_ON having constant frequency. When the S terminal of the first flip-flop FF1 is triggered by a logic 1 pulse signal NMOS_ON, the switch control signal NG outputted at its Q terminal switches from disable level to enable level, thereby turning on the power switch QN0 for charging the inductor L. All the switches are turned off during a turn-off time $T_0$ in the period T, so that the energy stored in the inductor L may be discharged through the parasite capacitance of the switches QP1-QP3. In the embodiment illustrated in FIG. 5*b*, the power switch QN0 is turned on according to a variable-frequency driving method in which the power switch QN0 is turned on immediately after the switch QP3 is turned off and the period T is the minimum cycle time. In the constant-frequency driving method, the pulse signal NMOS_ON may be triggered by a constant-frequency oscillator (not depicted); in the variable-frequency driving method, the pulse signal NMOS_ON may be triggered by the control signal of the last switch (such as PG3).

In the embodiments illustrated in FIGS. 5*a* and 5*b*, the power switch QN0 is turned off in the same manner: when the constant-slope ramp voltage SAW1 reaches the compare signal $V_C$, the R terminal of the first flip-flop FF1 is triggered by the first flip-flop FF1, and the switch control signal NG outputted at its R terminal switches from enable level to disable level. The power switch QN0 is thus turned off for terminating the charging of the inductor L. As described, the value of the compare voltage $V_C$ reflects the level of the output voltage $V_{OUT}$: if the output voltage $V_{OUT}$ is smaller than its expected value, the corresponding feedback voltage $V_{FB}$ drops and the error amplifier EA increases the compare voltage $V_C$ accordingly. Therefore, since it takes longer for the ramp voltage SAW1 to reach the compare voltage $V_C$, the turn-on time $T_N$ of the switch QN0 is increased, thereby raising the output voltage $V_{OUT}$ to its expected value by increasing the charging time of the inductor L; if the output voltage $V_{OUT}$ is larger than the expected value, the corresponding feedback voltage $V_{FB}$ increases and the error amplifier EA lowers the compare voltage $V_C$ accordingly. Therefore, since it takes shorter for the ramp voltage SAW1 to reach the compare voltage $V_C$, the turn-on time $T_N$ of the switch QN0 is shortened, thereby lowering the output voltage $V_{OUT}$ to its expected value by decreasing the charging time of the inductor L.

Figure 6:
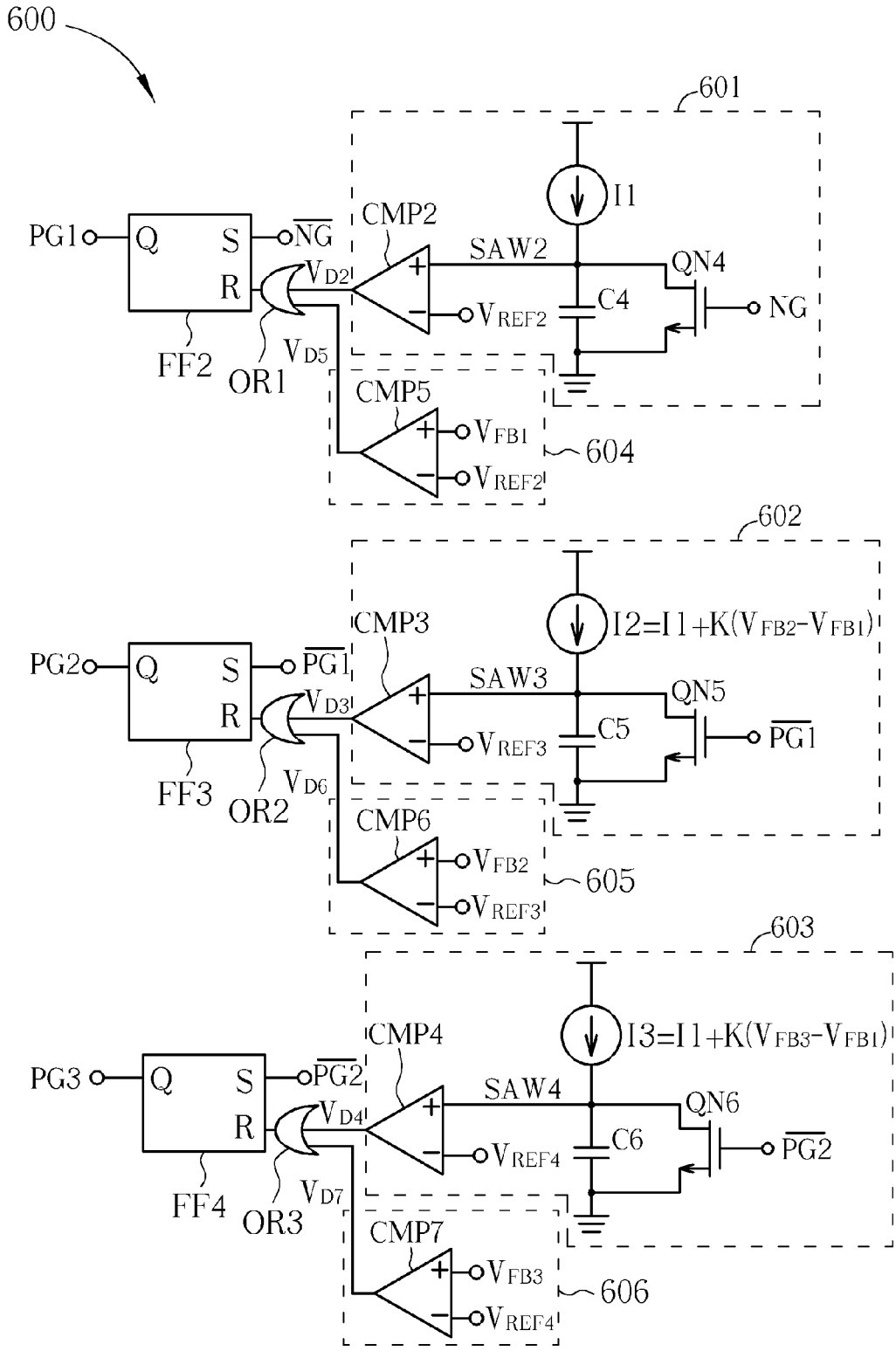
FIG. 6 is a diagram illustrating a switch control unit according to the present invention.
Figure 7:
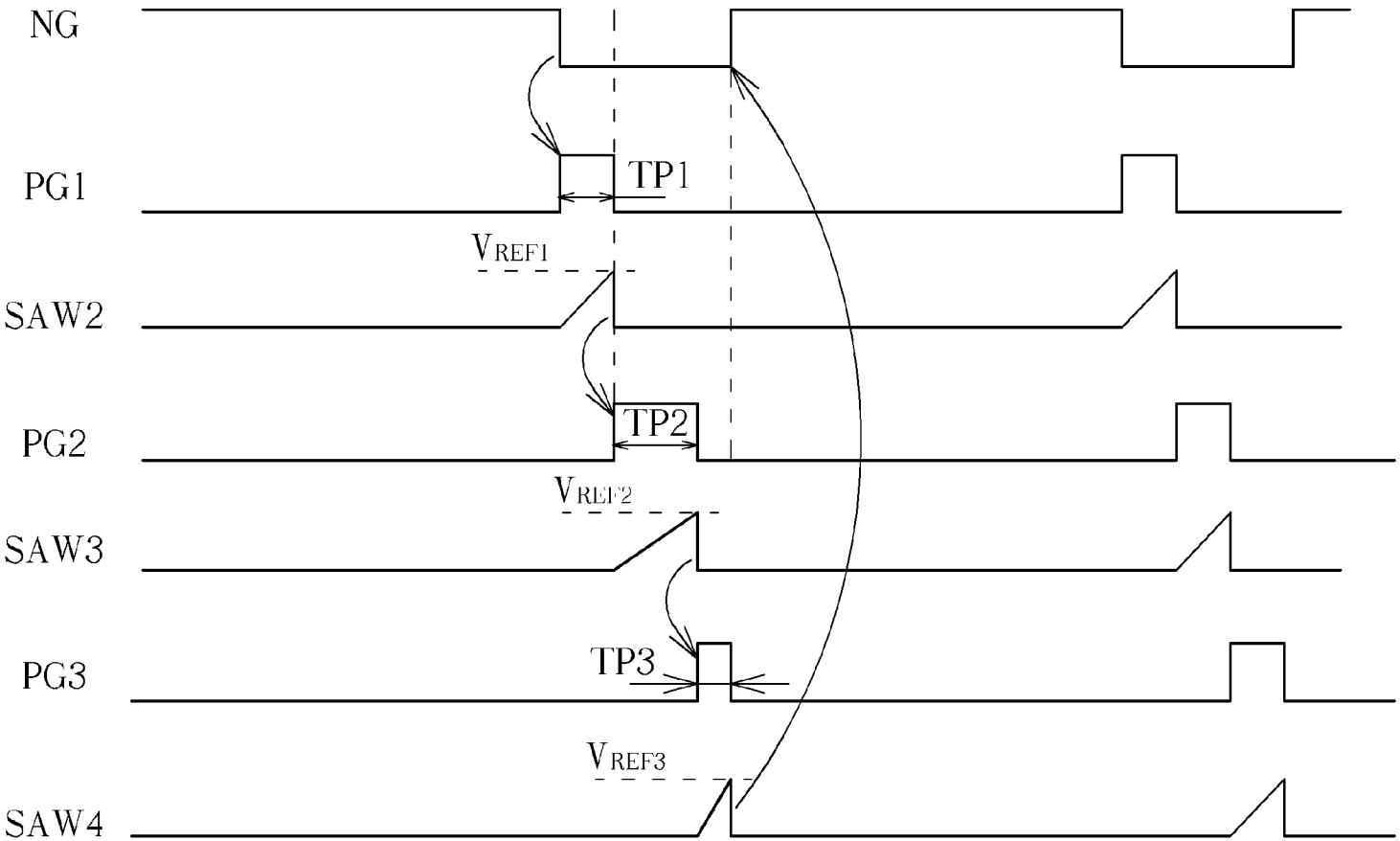
FIG. 7 is a timing diagram illustrating a variable-frequency driving method according to the present invention.
Figure 8:
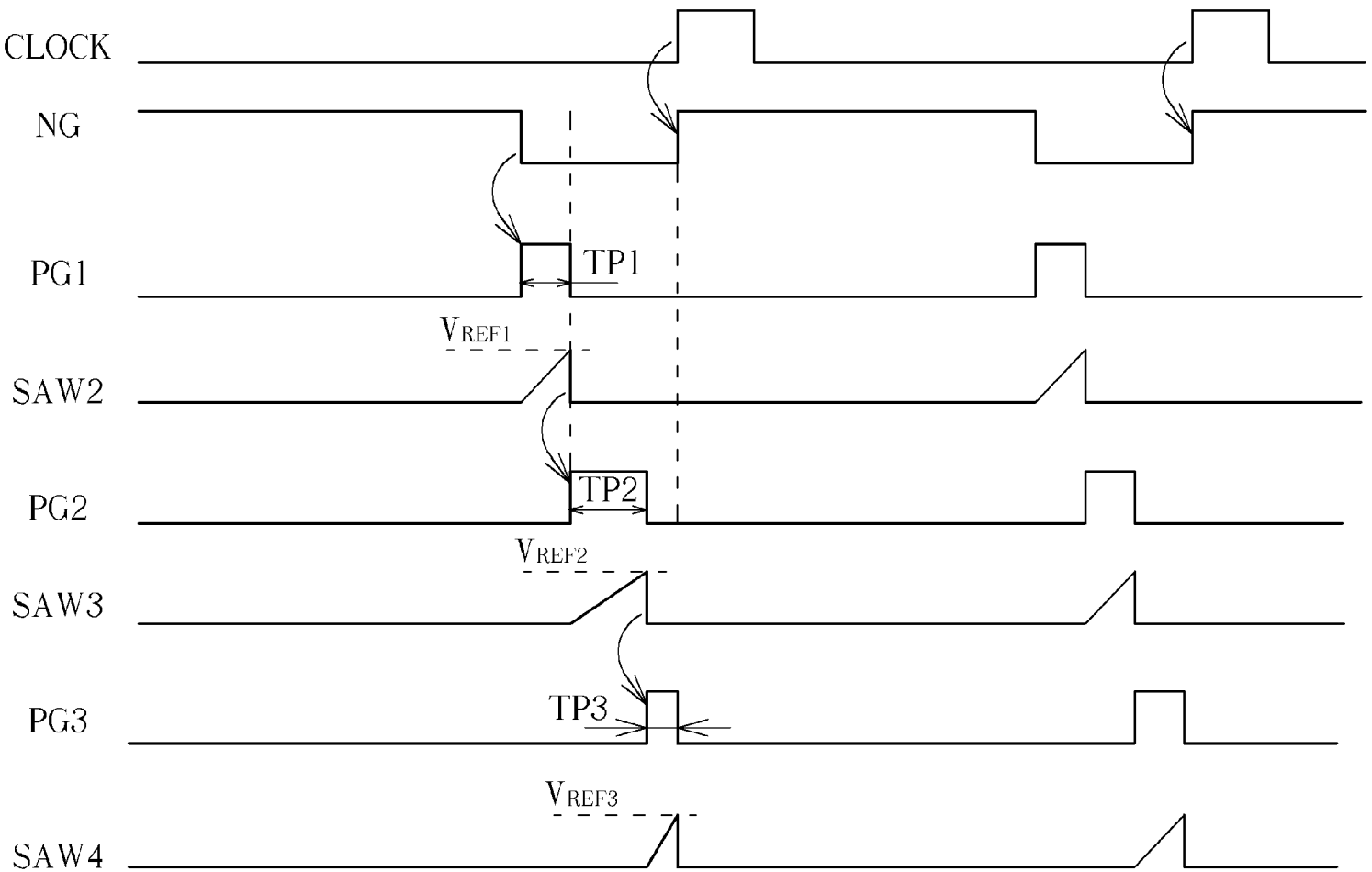
FIG. 8 is a timing diagram illustrating a constant-frequency driving method according to the present invention.

FIG. 6 is a diagram illustrating the switch control unit 600 according to the present invention. FIG. 7 is a timing diagram illustrating the variable-frequency driving method for operating the switches QP1-QP3 according to the present invention. FIG. 8 is a timing diagram illustrating the constant-frequency driving method for operating the switches QP1-QP3 according to the present invention. In the embodiment illustrated in FIG. 6, the switch control unit 600 includes first to sixth comparing circuits 601-606, second to fourth flip-flops FF2-FF4, first to third OR gates OR1-0R3, and an oscillator (not shown in FIG. 6). The first OR gate OR1 is configured to selectively trigger the R terminal of the second flip-flop FF2 according to a digital control signal $V_{D2}$ transmitted from the first comparing circuit 601 and a digital control signal $V_{D5}$ transmitted from the fourth comparing circuit 604; the second OR gate OR2 is configured to selectively trigger the R terminal of the third flip-flop FF3 according to a digital control signal $V_{D3}$ transmitted from the second comparing circuit 602 and the digital control signal $V_{D6}$ transmitted from the fifth comparing circuit 605; the third OR gate OR3 is configured to selectively trigger the R terminal of the fourth flip-flop FF4 according to the digital control signal $V_{D4}$ transmitted from the third comparing circuit 603 and the digital control signal $V_{D7}$ transmitted from the sixth comparing circuit 606.

First, the structures and operations of the first to third comparing circuits 601-603 are illustrated. The first comparing circuit 601 includes a second comparator CMP2, a fourth capacitor C4, a fourth switch QN4, and a first current source I1. The second comparing circuit 602 includes a third comparator CMP3, a fifth capacitor C5, a fifth switch QN5, and a second current source I2. The third comparing circuit 603 includes a fourth comparator CMP4, a sixth capacitor C6, a sixth switch QN6, and a third current source I3. The switches QN4-QN6 may be NMOS transistor switches which are configured to control the charging paths of the capacitors C4-C6 according to fourth to sixth control signals, respectively. In this embodiment, the fourth control signal may be the switch control signal NG, the fifth control signal may be a signal $\overline{PG1}$ whose phase is opposite to that of the first control signal PG1, and the sixth control signal may be a signal $\overline{PG2}$ whose phase is opposite to that of the second control signal PG2. The current source I1 is a constant current source, the value of the current source I2 is related to the difference between the feedback voltages $V_{FB1}$ and $V_{FB2}$, and the value of the current source I3 is related to the difference between the feedback voltages $V_{FB1}$ and $V_{FB3}$. The corresponding relationships are depicted as follow:

$$I2=I1+K(V_{FB2}-V_{FB1});$$

$$I3=I1+K(V_{FB3}-V_{FB2});$$

wherein K is a predetermined conversion ratio.

After the switch control signal NG switches to disable level, the S terminal of the flip-flop FF2 is triggered by a seventh control signal (which may be a signal $\overline{NG}$ whose phase is opposite to that of the switch control signal NG), and the control signal PG1 outputted from the Q terminal of the flip-flop FF2 switches to enable level, thereby turning on the switch QP1. At this time, the switch QN4 is turned off so that the current source I1 may charge the capacitor C4 for providing a constant-slope second ramp voltage SAW2. When the second ramp voltage SAW2 exceeds a second reference voltage $V_{REF2}$, the comparator CMP2 triggers the R terminal of the flip-flop FF2, and the control signal PG1 outputted from the Q terminal of the flip-flop FF2 switches to disable level, thereby turning off the switch QP1. In other words, the charge time of the capacitor C4 is determined by the turn-on time TP1 of the switch QP1, and the second ramp voltage saw2 reflects the level of the feedback voltage $V_{FB1}$ Next, the present invention determines when and how long the switch QP2 is turned on. After turning off the switch QP1, the switch QN5 is turned off by the fifth control signal $\overline{PG1}$, so that the current source I2 may charge the capacitor C5 for providing a constant-slope third ramp voltage SAW3. If the output voltage $V_{OUT2}$ does not reach its expected level after the switch QP1 is turned off, the smaller voltage difference ($V_{FB2}-V_{FB1}$) reduces the value of the current source I2 for charging the capacitor C5. It thus takes longer for the third ramp voltage SAW3 to reach the third reference voltage $V_{REF3}$, and the turn-on time TP2 of the switch QP2 may be increased for allowing the inductor L to discharge more energy, thereby raising the output voltage $V_{OUT2}$ to its expected level.

Similarly, the present invention determines when and how long the switch QP3 is turned on. After turning off the switch QP2, the switch QN6 is turned off by the sixth control signal $\overline{PG2}$, so that the current source I3 may charge the capacitor C6 for providing a constant-slope fourth ramp voltage SAW4. If the output voltage $V_{OUT3}$ exceeds its expected level after the switch QP2 is turned off, the larger voltage difference ($V_{FB3}-V_{FB1}$) increases the value of the current source I3 for charging the capacitor C6. It thus takes shorter for the fourth ramp voltage SAW4 to reach the fourth reference voltage $V_{REF4}$, and the turn-on time TP3 of the switch QP3 may be shortened for allowing the inductor L to discharge less energy, thereby lowering the output voltage $V_{OUT3}$ to its expected level.

On the other hand, if the comparing circuits 601-603 have mismatching characteristics due to process variations, one of the output voltages $V_{OUT1}$-$V_{OUT3}$ may be higher than the other two. Corresponding compensations may be made using the comparing circuits 604-606 in the present invention. The fourth comparing circuit 604 includes a fifth comparator CMP5 having two input ends for receiving the first feedback voltage $V_{FB1}$ and the second reference voltage $V_{REF2}$, and an output end coupled to the first OR gate OR1. The fifth comparing circuit 605 includes a sixth comparator CMP6 having two input ends for receiving the second feedback voltage $V_{FB2}$ and the third reference voltage $V_{REF3}$, and an output end coupled to the second OR gate OR2. The sixth comparing circuit 606 includes a seventh comparator CMP7 having two input ends for receiving the third feedback voltage $V_{FB3}$ and the fourth reference voltage $V_{REF4}$, and an output end coupled to the third OR gate OR3.

For example, if the feedback voltage $V_{FB1}$ exceeds the second reference voltage $V_{REF2}$ after the power switch QN0 is turned off and before the ramp voltage SAW2 reaches the second reference voltage $V_{REF2}$, the fourth comparing circuit 604 triggers the R terminal of the second flip-flop FF2, so that the first switch QP1 may be turned off earlier for reducing the energy supplied to the output voltage $V_{OUT1}$; if the feedback voltage $V_{FB2}$ exceeds the third reference voltage $V_{REF3}$ after the power switch QN0 is turned off and before the ramp voltage SAW3 reaches the third reference voltage $V_{REF3}$, the fifth comparing circuit 605 triggers the R terminal of the third flip-flop FF3, so that the second switch QP2 may be turned off earlier for reducing the energy supplied to the output voltage $V_{OUT2}$; if the feedback voltage $V_{FB3}$ exceeds the fourth reference voltage $V_{REF4}$ after the power switch QN0 is turned off and before the ramp voltage SAW4 reaches the fourth reference voltage $V_{REF4}$, the sixth comparing circuit 606 triggers the R terminal of the fourth flip-flop FF4, so that the third switch QP3 may be turned off earlier for reducing the energy supplied to the output voltage $V_{OUT3}$.

In other words, if the ramp voltage SAW2 reaches the reference voltage $V_{REF2}$ or the feedback voltage $V_{FB1}$ exceeds the reference voltage $V_{REF2}$ after the power switch QN0 is turned off, it is determined that the output voltage $V_{OUT1}$ has reached its expected value and the switch QP1 is turned off; if the ramp voltage SAW3 reaches the reference voltage $V_{REF3}$ or the feedback voltage $V_{FB2}$ exceeds the reference voltage $V_{REF3}$ after the power switch QN0 is turned off, it is determined that the output voltage $V_{OUT2}$ has reached its expected value and the switch QP2 is turned off; if the ramp voltage SAW4 reaches the reference voltage $V_{REF4}$ or the feedback voltage $V_{FB3}$ exceeds the reference voltage $V_{REF4}$ after the power switch QN0 is turned off, it is determined that the output voltage $V_{OUT3}$ has reached its expected value and the switch QP3 is turned off.

In the present invention, the main loop in the backlight module is controlled according to the first feedback voltage $V_{FB1}$ using a constant-frequency or variable-frequency method. Therefore, the first output voltage $V_{OUT1}$ may be maintained at its expected value by adjusting the switch control signal NG according to the first output voltage $V_{OUT1}$. For respective output routes, the output voltages $V_{OUT1}$–$V_{OUT1}$ may be maintained at their expected values by controlling the turn-on time of the switches QP1-QP3 according to the differences between the feedback voltages $V_{FB1}$–$V_{FB3}$. Since only one inductor L is required, the size of the backlight module and the manufacturing costs may be reduced. The RGB backlight may be driven efficiently according the characteristics of each type of LED.

Those skilled in the art will readily observe that numerous modifications and alterations of the device and method may be made while retaining the teachings of the invention.

What is claimed is:

1. A voltage converter for use in a backlight module, comprising:

an inductor configured to store an energy of an input voltage;

a power switch configured to control a charging path of the inductor according to a switch control signal;

a first capacitor configured to provide a first output voltage by storing an energy of the inductor;

a second capacitor configured to provide a second output voltage by storing the energy of the inductor;

a third capacitor configured to provide a third output voltage by storing the energy of the inductor;

a first switch configured to control a signal transmission path between the inductor and the first capacitor according to a first control signal;

a second switch configured to control a signal transmission path between the inductor and the second capacitor according to a second control signal;

a third switch configured to control a signal transmission path between the inductor and the third capacitor according to a third control signal;

a first feedback circuit configured to provide a first feedback voltage corresponding to the first output voltage;

a second feedback circuit configured to provide a second feedback voltage corresponding to the second output voltage;

a third feedback circuit configured to provide a third feedback voltage corresponding to the third output voltage; and a boost control circuit configured to generate the switch control signal according to the first feedback signal, generate the first control signal according to the first feedback signal and the switch control signal, generate the second control signal according to the first feedback signal, the second feedback signal and the first control signal, and generate the third control signal according to the first feedback signal, the third feedback signal and the second control signal.

2. The voltage converter of claim 1, wherein the boost control circuit comprises:

an error amplifier configured to generate a first compare signal by comparing a difference between the first feedback voltage and a first reference voltage;

a first comparator configured to generate a first digital control signal according to the first compare signal and a first ramp voltage;

a switch control unit configured to generate the first, the second and the third control signals according to the first, the second and the third feedback voltages; and a first flip-flop configured to generate the switch control signal according to the first digital control signal.

3. The voltage converter of claim 2, wherein the switch control unit comprises:

a first, a second and a third current sources configured to provide a first, a second and a third charging currents, respectively;

a fourth, a fifth and a sixth capacitors respectively coupled in series with the first, the second and the third current sources and respectively configured to provide a second, a third and a fourth ramp voltages by respectively storing energy of the first, the second and the third charging currents;

a fourth, a fifth and a sixth switches respectively coupled in parallel with the fourth, the fifth and the sixth capacitors and respectively configured to control charging paths of the fourth, the fifth and the sixth capacitors according to a fourth, a fifth and a sixth control signals, respectively;

a second comparator configured to generate a second digital control signal according to the second ramp voltage and a second reference voltage;

a third comparator configured to generate a third digital control signal according to the third ramp voltage and a third reference voltage;

a fourth comparator configured to generate a fourth digital control signal according to the fourth ramp voltage and a fourth reference voltage;

a second flip-flop configured to output the first control signal according to a seventh control signal and the second digital control signal, wherein the fourth and the seventh control signals have opposite phases;

a third flip-flop configured to output the second control signal according to the fifth control signal and the third digital control signal; and a fourth flip-flop configured to output the third control signal according to the sixth control signal and the fourth digital control signal.

4. The voltage converter of claim 3, wherein the fourth control signal is the switch control signal, the first and the fifth control signals have opposite phases, and the second and the sixth control signals have opposite phases.

5. The voltage converter of claim 3, wherein the switch control unit further comprises:

a fifth comparator configured to output a fifth digital control signal according to the first feedback voltage and the second reference voltage;

a sixth comparator configured to output a sixth digital control signal according to the second feedback voltage and the third reference voltage;

a seventh comparator configured to output a seventh digital control signal according to the third feedback voltage and the fourth reference voltage;

wherein the second flip-flop outputs the first control signal further according to the fifth digital control signal, the third flip-flop outputs the second control signal further according to the sixth digital control signal, the fourth flip-flop outputs the third control signal further according to the seventh digital control signal.

6. The voltage converter of claim 5, wherein the switch control unit further comprises:

a first OR gate configured to selectively trigger the second flip-flop according to the second digital control signal and the fifth digital control signal;

a second OR gate configured to selectively trigger the third flip-flop according to the third digital control signal and the sixth digital control signal; and a third OR gate configured to selectively trigger the fourth flip-flop according to the fourth digital control signal and the seventh digital control signal.

7. The voltage converter of claim 3, wherein the second charging current is related to a difference between the first feedback voltage and the second feedback voltage, and the third charging current is related to a difference between the first feedback voltage and the third feedback voltage.

8. The voltage converter of claim 3, wherein the power switch, the fourth switch, the fifth switch and the sixth switch are N-type metal-oxide-semiconductor (NMOS) transistor switches, and the first switch, the second switch and the third switch are P-type metal-oxide-semiconductor (PMOS) transistor switches.

9. The voltage converter of claim 8, wherein the fourth control signal is the switch control signal, the first and the fifth control signals have opposite phases, and the second and the sixth control signals have opposite phases.

10. The voltage converter of claim 3, wherein the first, the second, the third, and the fourth flip-flops are RS flip-flops.

11. The voltage converter of claim 3, wherein the first, the second and the third feedback circuits each include a plurality of resistors coupled in series.

12. The voltage converter of claim 1, wherein the first, the second and the third feedback circuits each include a plurality of resistors coupled in series.

13. A driving method for operating a backlight module, comprising:

an energy-storing device receiving an input voltage for storing a corresponding energy;

providing a first output voltage, a second output voltage and a third output voltage by receiving the energy stored in the energy-storing device;

controlling a signal transmission path between the input voltage and the energy-storing device according to a first feedback voltage, wherein the first feedback voltage is related to the first output voltage;

controlling a signal transmission path between the energy-storing device and the first output voltage according to the first feedback voltage;

controlling a signal transmission path between the energy-storing device and the second output voltage according to the first feedback voltage and a second feedback voltage, wherein the second feedback voltage is related to the second output voltage; and controlling a signal transmission path between the energy-storing device and the third output voltage according to the first feedback voltage and a third feedback voltage, wherein the third feedback voltage is related to the third output voltage.

14. The driving method of claim 13, wherein the energy-storing device is an inductor.

* * * * *

UNITED STATES PATENT AND TRADEMARK OFFICE

CERTIFICATE OF CORRECTION

PATENT NO. : 8,232,743 B2
APPLICATION NO. : 12/831231
DATED : July 31, 2012
INVENTOR(S) : Ke-Horng Chen et al.

It is certified that error appears in the above-identified patent and that said Letters Patent is hereby corrected as shown below:

On the title page, item (73), correct the name of the assignee from "Chunghwa Pictures Tubes, Ltd." to --Chunghwa Picture Tubes, Ltd.--.

Signed and Sealed this
Twenty-third Day of October, 2012

David J. Kappos

David J. Kappos
*Director of the United States Patent and Trademark Office*